US006911776B2

(12) United States Patent
Nishida

(10) Patent No.: US 6,911,776 B2
(45) **Date of Patent: *Jun. 28, 2005**

(54) HIGH-PRESSURE DISCHARGE LAMP

(75) Inventor: Kazuhisa Nishida, Tokyo (JP)

(73) Assignee: NEC Corporation, Tokyo (JP)

( * ) Notice: Subject to any disclaimer, the term of this patent is extended or adjusted under 35 U.S.C. 154(b) by 5 days.

This patent is subject to a terminal disclaimer.

(21) Appl. No.: 10/197,483

(22) Filed: Jul. 18, 2002

(65) Prior Publication Data

US 2003/0030379 A1 Feb. 13, 2003

(30) Foreign Application Priority Data

Aug. 3, 2001 (JP) ..... 2001-236068

(51) Int. Cl.[7] ..... H01J 17/20

(52) U.S. Cl. ..... 313/639; 313/642; 313/643; 313/571

(58) Field of Search ..... 313/643, 639, 313/642, 638, 637, 568, 570, 571, 572

(56) References Cited

U.S. PATENT DOCUMENTS 5,093,601 A * 3/1992 Watanabe et al. ..... 313/25
6,211,616 B1 * 4/2001 Takeuti et al. ..... 313/637
6,570,329 B2 * 5/2003 Nishida ..... 313/639
6,608,440 B2 * 8/2003 Nishida et al. ..... 313/568
6,669,522 B2 * 12/2003 Nishida ..... 445/26

FOREIGN PATENT DOCUMENTS

| | | |
|---|---|---|
| JP | 6-349410 | 12/1994 |
| JP | 7-057697 | 3/1995 |
| JP | 8-287867 | 11/1996 |
| JP | 9-086959 | 3/1997 |
| JP | 11-297268 | 10/1999 |
| JP | 2980882 | 11/1999 |

* cited by examiner

*Primary Examiner*—Edward J. Glick
*Assistant Examiner*—Elizabeth Keaney
(74) *Attorney, Agent, or Firm*—Whitham, Curtis & Christofferson, PC

(57) ABSTRACT

A long-life high-pressure discharge lamp suffers reduced blackening and luminance drop even after it has been turned on over a long period of time, and is arranged to prevent the internal gases from leaking out and also to prevent the lamp bulb from being ruptured. The high-pressure discharge lamp has a pair of confronting electrodes inserted in a lamp bulb which confines therein at least mercury and a halogen gas. The lamp bulb contains oxygen at a partial pressure lower than a partial pressure which can maintain a luminance of 80% after 100 hours of operation and equal to or higher than $1.0\times10^{-5}$ Pa.

18 Claims, 3 Drawing Sheets

HIGH-PRESSURE DISCHARGE LAMP

BACKGROUND OF THE INVENTION

1. Field of the Invention

The present invention relates to a high-pressure discharge lamp, and more particularly to a long-life high-pressure discharge lamp which is arranged to prevent the internal gases from leaking out and also to prevent the lamp bulb from being ruptured, and which suffers reduced blackening and luminance drop even after it has been turned on over a long period of time.

2. Description of the Related Art

As shown in FIG. 1 of the accompanying drawings, high-pressure discharge lamp 101 generally has a pair of confronting tungsten electrodes 102 inserted in lamp bulb 101 of quartz glass which has a spherical central portion. Electrodes 102 are inserted respectively from insertion slots 104 defined in the respective opposite ends of lamp bulb 101. Insertion slots 104 are hermetically sealed by respective electrodes 102 fitted in respective sleeves 105 of molybdenum foil which serve as thermal dampers. Mercury, a halogen gas such as of methylene bromide or the like, and an inactive gas such as of argon or the like are introduced and confined in lamp bulb 101.

For example, mercury is introduced and confined at a rate of 0.15 mg/mm$^3$ or higher in the lamp bulb 101. When a trigger voltage is applied between electrodes 102, a glow discharge is induced between electrodes 102 in the presence of the inactive gas, vaporizing the mercury, and a plasma discharge caused in the high-pressure mercury gas radiates highly color rendering light with high luminance. Since high-pressure discharge lamps are capable of emitting highly color rendering light with high luminance, they have in recent years attracted much attention and widely been used as light sources for projection-type liquid crystal display devices or the like.

It has been pointed out that early high-pressure discharge lamps suffer blackening on the inner wall surfaces of their lamp bulbs, resulting in a reduction in the amount of emitted light, after they have been turned on over a long period of time. Such a phenomenon is caused when tungsten W vaporized from electrodes 102 by a discharge at high temperature are deposited on the bulb wall, as shown in FIG. 1. In an effort to prevent blackening on the bulb wall halogen gas has been sealed in the lamp bulb. The introduced halogen gas generates halogen ions at the high temperature, and the halogen ions are united with the tungsten deposited on the bulb wall and vaporized and deposited on electrode bases which are of a relatively low temperature. Such a halogen cycle is repeated to prevent the blackening of the bulb wall.

The halogen gas usually comprises a halogen compound such as methylene bromide or the like. When the discharge lamp is energized, the halogen compound is decomposed, generating halogen ions. The halogen gas is introduced and confined in the lamp bulb in an amount that is effective to prevent the blackening, i.e., in such an amount that the halogen sealed in the lamp bulb has a partial pressure of $1\times10^{-6}$ $\mu$mol/mm$^3$ or higher.

An inactive gas such as of argon or the like is also introduced and confined in the lamp bulb under a pressure ranging from $6\times10^3$ Pa to $6\times10^4$ Pa in order to induce a glow discharge when the discharge lamp is turned on.

If the halogen gas introduced and confined in the high-pressure discharge lamp exists in an excessive amount, then it tends to erode and degrade electrodes 102 and molybdenum foil sleeves 105 at the sealed ends of the lamp bulb. When electrodes 102 and molybdenum foil sleeves 105 are highly eroded and degraded, since a high pressure of 100 atms is developed in the lamp bulb due to the vapor pressure of the sealed mercury, the gases tend to leak from the sealed ends of the lamp bulb, and the sealed ends are likely to be ruptured. In order to prevent the bulb wall from blackening, to prevent the gases from leaking, and also to prevent the lamp bulb from being broken, research efforts have been made to improve high-pressure discharge lamps, including designing the structure thereof and adjusting the amounts of various components of gases to be sealed in the lamp bulb.

For example, Japanese laid-open patent publication No. 11-149899 discloses a high-pressure discharge lamp which is filled with mercury in an amount ranging from 0.12 to 0.35 mg/mm$^3$ and a halogen gas in an amount ranging from $10^{-7}$ to $10^{-2}$ $\mu$mol/mm$^3$, with the electrodes containing 12 ppm of potassium oxide.

Japanese patent No. 2829339 reveals a high-pressure discharge lamp which contains mercury in an amount ranging from 0.2 to 0.35 mg/mm$^3$ and a halogen gas in an amount ranging from $10^{-6}$ to $10^{-4}$ $\mu$mol/mm$^3$.

Japanese patent No. 2980882 reveals a high-pressure discharge lamp which contains with mercury in an amount ranging from 0.16 mg/mm$^3$ or higher and a halogen gas in an amount ranging from $2\times10^{-4}$ to $7\times10^{-3}$ $\mu$mol/mm$^3$. Preferably, the load on the bulb wall is 0.8 W/mm$^2$ or higher, and an inactive gas is introduced and confined in the lamp bulb at a pressure of $5\times10^3$ Pa or higher.

Japanese laid-open patent publication No. 11-297274 discloses a high-pressure discharge lamp which contains mercury in such an amount that it develops a vapor pressure ranging from 100 to 200 atms at the time the high-pressure discharge lamp is turned on, and a halogen gas in an amount ranging from $1.1\times10^{-5}$ to $1.2\times10^{-7}$ mol/cc.

However, the problems of the reduction in luminance due to blackening, leakage of gases from the sealed ends, and rupture of the lamp bulb cannot be solved together no matter how the amounts of gases introduced and confined in the lamp bulbs are adjusted as disclosed in the above prior art.

SUMMARY OF THE INVENTION

It is therefore an object of the present invention to provide a long-life high-pressure discharge lamp which suffers reduced blackening and luminance drop even after it has been turned on over a long period of time, and which is arranged to prevent the internal gases from leaking out and also to prevent the lamp bulb from being ruptured.

As a result of research efforts made to solve the above problems, the inventor of the present invention has found that while air is discharged from the lamp bulbs of the conventional high-pressure discharge lamps by a vacuum pump before various gases are introduced into the lamp bulb, oxygen components such as an oxygen gas and a carbon dioxide gas remaining in the lamp bulb impair the halogen cycle when the high-pressure discharge lamp is energized.

The inventor has also revealed that even if the introduced amounts of oxygen components are the same, different halogen gas concentrations impair the halogen cycle to different degrees. Further research activities have shown that if an oxygen partial pressure is of a certain value when a halogen gas is confined at a predetermined concentration, then it is possible to keep the luminance at 100%, and reducing the oxygen components below the certain value of the oxygen partial pressure is not effective to increase the luminance. That is, the inventor has found that there is a preferable range of oxygen partial pressures depending on the halogen gas concentration.

The present invention is achieved based on the above findings. According to the present invention, there is provided a high-pressure discharge tube comprising a hermetically sealed lamp bulb of quartz glass, a pair of confronting electrodes inserted in the lamp bulb, mercury confined in the lamp bulb, and a halogen gas confined in the lamp bulb and having a predetermined concentration, the lamp bulb containing oxygen at a partial pressure lower than a partial pressure which can maintain a luminance of 80% after 100 hours of operation and equal to or higher than $1.0\times10^{-5}$ Pa.

According to the present invention, there is also provided a high-pressure discharge tube comprising a hermetically sealed lamp bulb of quartz glass, a pair of confronting electrodes inserted in the lamp bulb, mercury confined in the lamp bulb, and a halogen gas confined in the lamp bulb and having a predetermined concentration, the lamp bulb containing oxygen at a partial pressure lower than a partial pressure which can maintain a luminance of 90% after 100 hours of operation and equal to or higher than $1.0\times10^{-5}$ Pa.

Since the oxygen partial pressure is in a range for keeping the luminance at 80% or 90%, the high-pressure discharge tube is of a long service life. The range of the oxygen partial pressure is determined depending on the halogen gas concentration, the oxygen partial pressure is not required to be excessively low.

The term "partial pressure" or "oxygen partial pressure" used herein refers to a partial pressure of not only oxygen molecules ($O_2$), but also molecules including oxygen atoms (hereinafter referred to as oxygen or the like), such as a carbon dioxide gas ($CO_2$), carbon monoxide (CO), water ($H_2O$), etc., with the atomic weight of oxygen being converted into oxygen molecules.

The oxygen partial pressure is defined on the basis of a luminance retention percentage after 100 hours of operation because it is suitable for the evaluation of the effect of blackening based on a failure of the halogen cycle to function fully. Specifically, when a high-pressure discharge lamp designed under normal conditions has operated for 200 through 500 hours under normal conditions, the luminance thereof is reduced based on the devitrification of quartz which the lamp bulb is made of. Therefore, it is suitable to evaluate the effect of blackening based on a failure of the halogen cycle to function fully after 100 hours of operation when no luminance drop occurs based on the devitrification of quartz.

According to the present invention, the lower limit of the oxygen partial pressure is $1.0\times10^{-5}$ Pa because it is a limit value at which the lamp bulb can be evacuated by an evacuating facility used in industrial applications. A more preferable lower limit is 1/10 of a maximum value of a partial pressure which can maintain a luminance of 100% after 100 hours of operation with the halogen gas confined in the lamp bulb at the above concentration. A much more preferable lower limit is a maximum value of a partial pressure which can maintain a luminance of 100% after 100 hours of operation with the halogen gas confined in the lamp bulb-at the above concentration.

If the luminance retention percentage is 100%, then any further reduction in the oxygen partial pressure is not required. Therefore, an ideal lower limit of the oxygen partial pressure is the maximum value of the partial pressure which can maintain a luminance of 100%. However, it is difficult to equalize the oxygen partial pressure fully to a desired value when the oxygen partial pressure is actually controlled.

Therefore, a more preferable lower limit is set to 1/10 of a maximum value of a partial pressure which can maintain a luminance of 100% after 100 hours of operation, and a much more preferable lower limit is set to a maximum value of a partial pressure which can maintain a luminance of 100% after 100 hours of operation.

Since the oxygen partial pressure may be lowered in a range required to maintain the luminance at a desired level, the facility for evacuating the lamp bulb is not required to be excessively large in scale.

A preferable range of halogen gas concentrations is up to $9.9\times10^{-7}$ $\mu$mol/mm$^3$.

The range up to $9.9\times10^{-7}$ $\mu$mol/mm$^3$ is effective to prevent the halogen gas from eroding the electrodes and molybdenum foil, and hence to prevent internal gases from leaking out of the lamp bulb. Consequently, the high-pressure discharge tube can be of an increased service life.

The term "halogen gas concentration" used herein refers to the molar concentration of a halogen compound as converted into halogen ions which are generated when the halogen compound is decomposed due to energization of the high-pressure discharge tube.

According to the present invention, as described above, the high-pressure discharge lamp is of a long life, suffers reduced blackening and luminance drop even after it has been turned on over a long period of time, and is arranged to prevent the internal gases from leaking out and also to prevent the lamp bulb from being ruptured.

The above and other objects, features, and advantages of the present invention will become apparent from the following description based on the accompanying drawings, which illustrate examples of preferred embodiments of the present invention.

DESCRIPTION OF THE PREFERRED EMBODIMENT

An embodiment of the present invention will be described in specific detail below. While the embodiment to be described below is a preferred embodiment of the present invention, it should not be interpreted as being limited to the present invention in any way.

Figure 1:
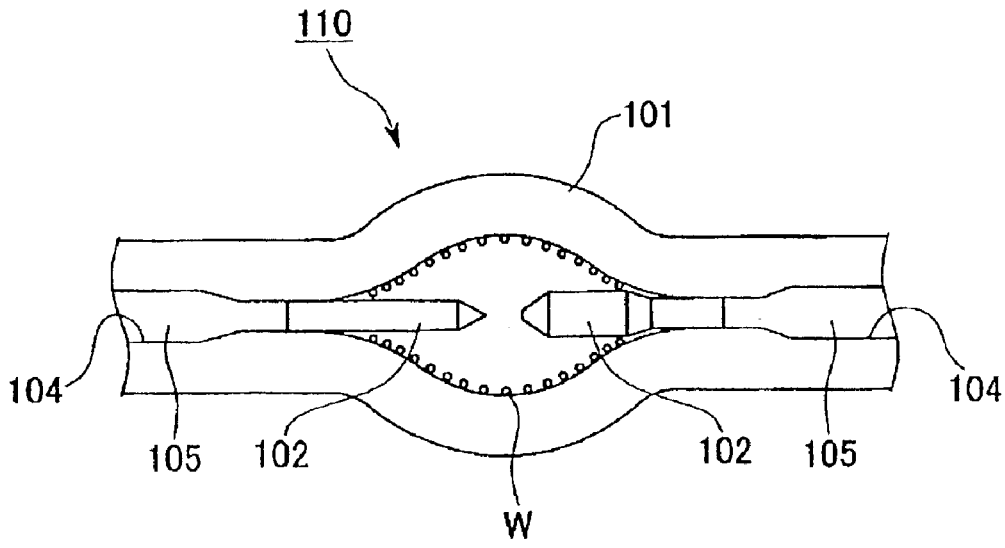
Fig. 1 Prior Art
FIG. 1 is a fragmentary cross-sectional view of a conventional high-pressure discharge lamp.
Figure 2:
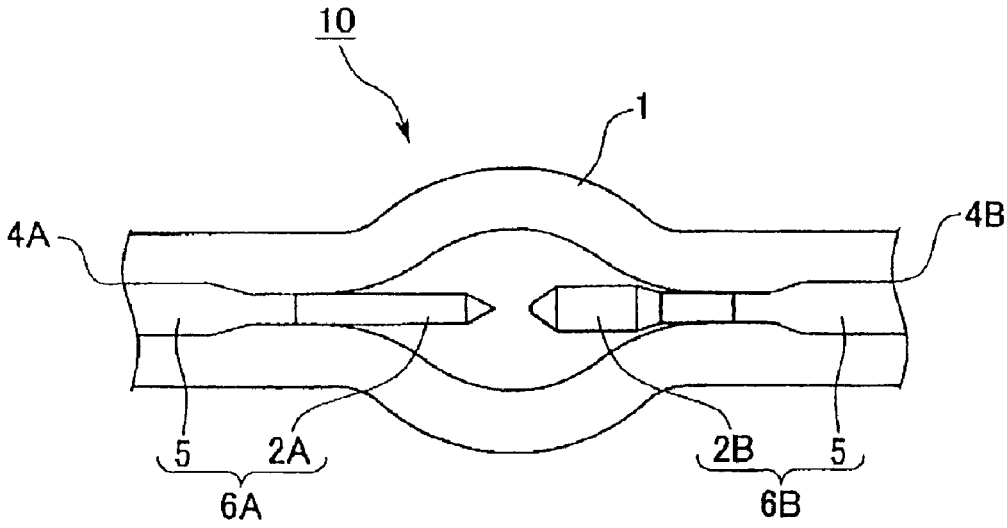
FIG. 2 is a fragmentary cross-sectional view of a high-pressure discharge lamp according to an embodiment of the present invention.

FIG. 2 shows high-pressure discharge lamp 10 according to an embodiment of the present invention. As shown in FIG. 2, high-pressure discharge lamp 10 has a pair of confronting tungsten electrodes 2A, 2B inserted in lamp bulb 1 of quartz glass which has a spherical central portion. High-pressure discharge lamp 10 shown in FIG. 2 comprises a DC high-pressure discharge lamp, and hence electrodes 2A, 2B are of different shapes. However, if high-pressure discharge lamp 10 comprises an AC high-pressure discharge lamp, then electrodes 2A, 2B are of identical shapes. The principles of the present invention are applicable to both DC and AC high-pressure discharge lamps.

Electrodes 2A, 2B are inserted respectively from insertion slots 4A, 4B defined in the respective opposite ends of lamp bulb 1. Insertion slots 4A, 4B are hermetically sealed by respective electrodes 2A, 2B fitted in respective sleeves 5 of molybdenum foil which serve as thermal dampers.

Oxygen or the like is discharged from hermetically sealed lamp bulb 1 to the extent that the remaining oxygen has a partial pressure of about $5\times10^{-4}$ Pa. After the oxygen or the like is discharged, mercury, a halogen gas of methylene bromide, and an inactive gas comprising an argon gas are introduced and confined in lamp bulb 1.

In the present embodiment, lamp bulb 1 contains mercury at a rate ranging from about 0.15 to 0.25 mg/mm$^3$, a halogen gas of methylene bromide at a rate of $9.9\times10^{-7}$ $\mu$mol/mm$^3$, and an argon gas at a pressure of 150 kPa.

When a trigger voltage is applied between electrodes 2A, 2B, a glow discharge is induced between electrodes 2A, 2B in the presence of the inactive gas (argon gas), vaporizing the mercury, and a plasma discharge caused in the high-pressure mercury gas radiates highly color rendering light with high luminance.

At this time, tungsten is vaporized from electrodes 2A, 2B heated to a high temperature by the glow discharge, and is deposited on the bulb wall. The introduced methylene bromide generates bromide ions at the high temperature, and the bromide ions are united with the tungsten deposited on the bulb wall and vaporized and deposited on electrode bases which are of a relatively low temperature. Such a halogen cycle is repeated to prevent the blackening of the bulb wall. Therefore, even after high-pressure discharge lamp 10 has been turned on over a long period of time, the bulb wall is not blackened, and high-pressure discharge lamp 10 can emit light continuously at an initial level.

Since oxygen or the like is discharged from lamp bulb 1 to the extent that the remaining oxygen has a partial pressure of about $5\times10^{-4}$ Pa, the halogen cycle is not impaired. Because the partial pressure of oxygen is not unnecessarily low, no large-scale evacuating facility is required to discharge oxygen or the like from lamp bulb 1.

Furthermore, inasmuch as the concentration of the halogen gas is low, it is less likely to erode electrodes 2A, 2B and molybdenum foil sleeves 5 in the sealed ends of lamp bulb 1, thus preventing the gases from leaking through the sealed ends of lamp bulb 1 and also preventing lamp bulb 1 from being ruptured.

Figure 3:
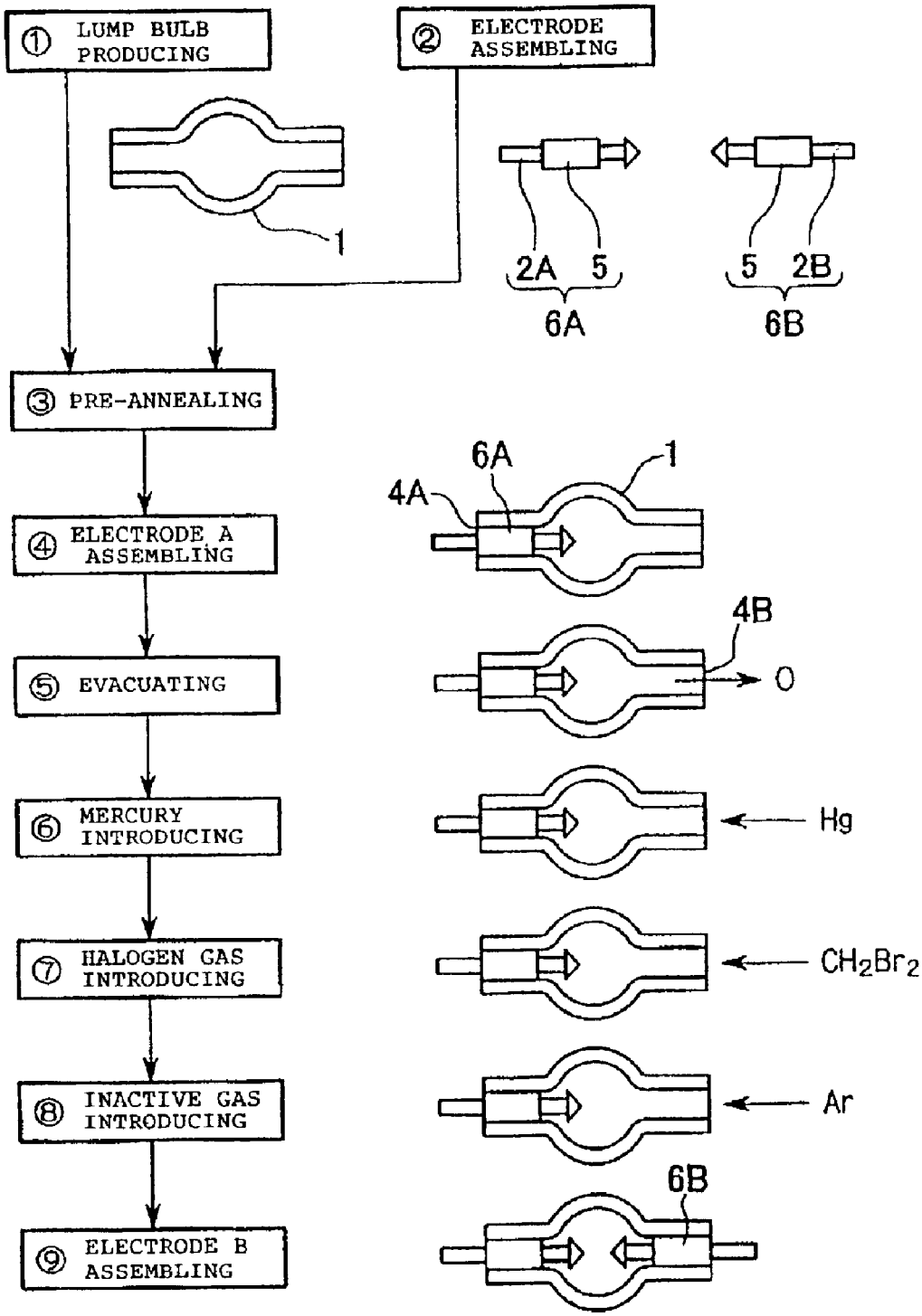
FIG. 3 is a diagram illustrative of a process of manufacturing the high-pressure discharge lamp according to the embodiment of the present invention.

High-pressure discharge lamp 10 is manufactured according to a process shown in FIG. 3.

① Lamp bulb producing step: Lamp bulb 1 is made of quartz glass.

② Electrode assembling step: Molybdenum foil sleeves 5 are mounted respectively on tungsten electrodes 2A, 2B, preparing electrode assemblies 6A, 6B.

③ Pre-annealing step: Lamp bulb 1 and electrode assemblies 6A, 6B are pre-annealed by heating at 1100° C. in a vacuum for 2 hours.

④ Electrode A assembling step: Electrode assembly 6A is inserted into insertion slot 4A, and then sealed by heating at 1700° C. for a few minutes.

⑤ Evacuating step: Lamp bulb 1 is evacuated through other insertion slot 4B until the partial pressure of oxygen in lamp bulb 1 reaches $5.0\times10^{-4}$ Pa.

⑥ Mercury introducing step: Mercury is introduced into lamp bulb 1 through insertion slot 4B at a rate ranging from 0.15 to 0.25 mg/mm$^3$.

⑦ Halogen gas introducing step: Methylene bromide (CH2Br2) is introduced into lamp bulb 1 through insertion slot 4B at a rate of $9.9\times10^{-7}$ $\mu$mol/mm$^3$.

⑧ Inactive gas introducing step: An argon gas is introduced into lamp bulb 1 through insertion slot 4B at a pressure of 150 kPa.

⑨ Electrode B assembling step: Electrode assembly 6B is inserted into insertion slot 4*b*, and then sealed by heating at 1700° C. for a few minutes, thus completing high-pressure discharge lamp 10.

The mercury introducing step ⑥, the halogen gas introducing step ⑦, and the inactive gas introducing step ⑧ may be switched around, and the halogen gas and the inactive gas may be premixed with each other before being introduced into lamp bulb 1 or may simultaneously be introduced into lamp bulb 1, thus omitting one of the manufacturing steps.

The fact that high-pressure discharge lamp 10 contains oxygen under a necessary and sufficient partial pressure will be described below based on experimental results.

Figure 4:
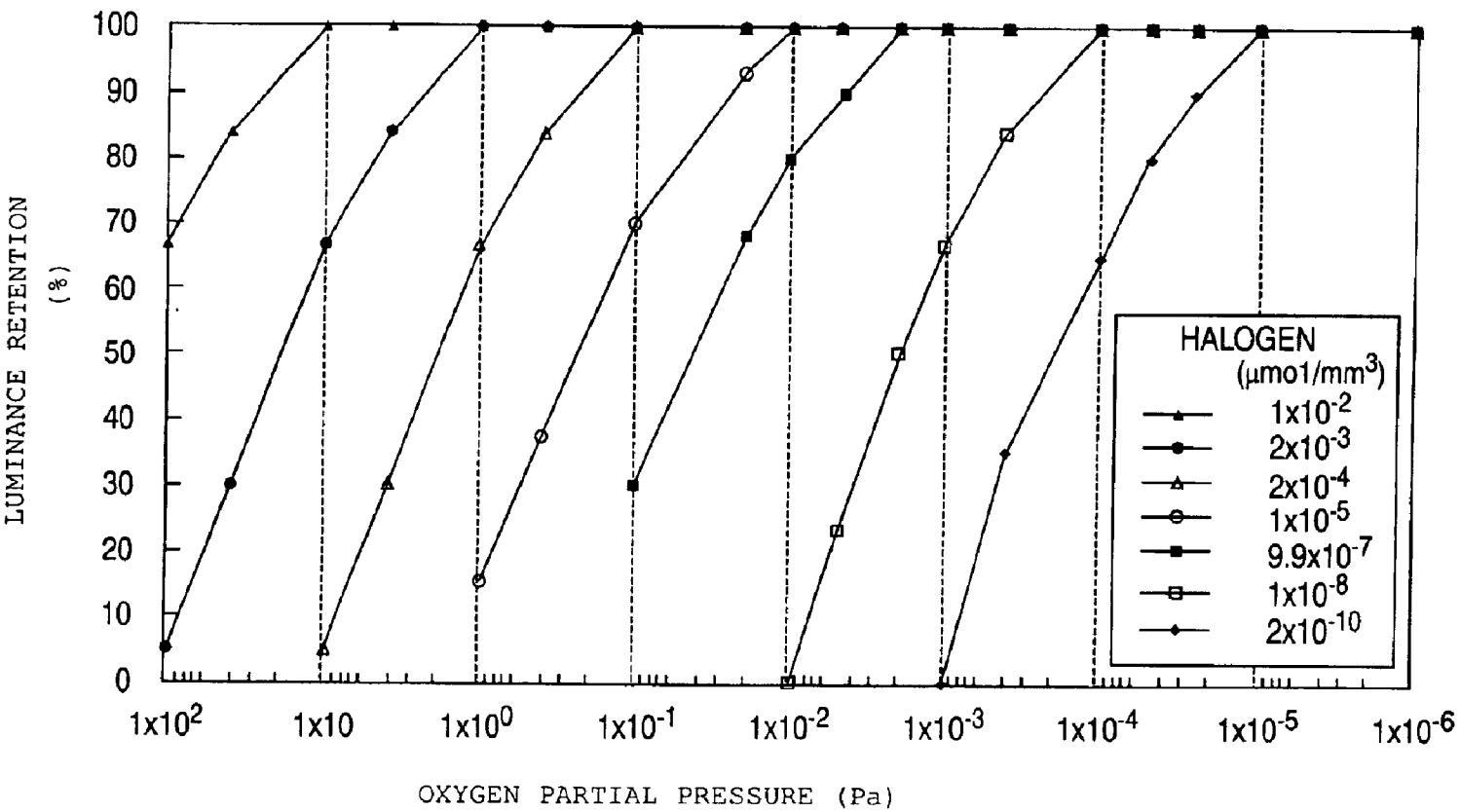
FIG. 4 is a graph of luminance retention percentages for explaining advantages of the present invention.

Mercury was introduced and confined at a rate of 0.20 mg/mm$^3$ and an argon gas was introduced and confined at a pressure of 150 kPa with various different methylene bromide concentrations and oxygen pressures, preparing various high-pressure discharge lamps, and luminance retention percentages of the high-pressure discharge lamps after having operated for 100 hours were measured. The results are shown in FIG. 4. In FIG. 4, the concentrations indicated as "HALOGEN" refer to halogen gas concentrations (methylene bromide concentrations as converted into halogen gas concentrations).

As shown in FIG. 4, even if the oxygen partial pressure is the same, different halogen gas concentrations result in different luminance retention percentages. It thus follows that even if the oxygen partial pressure is the same, different halogen gas concentrations impair the halogen cycle to different degrees.

Furthermore, as shown in FIG. 4, the luminance retention percentage rises as the oxygen partial pressure decreases at any halogen gas concentrations. If a certain oxygen partial pressure is reached, the luminance retention percentage reaches 100% and remains unchanged. It can thus be seen that depending on the halogen gas concentration, there is a certain threshold for the oxygen partial pressure and any oxygen partial pressures lower than the threshold are useless.

Therefore, it has been found that there is a certain preferable range of oxygen partial pressures for high-pressure discharge lamps depending on the halogen gas concentration, and the oxygen partial pressure should not be reduced unnecessarily.

For example, the halogen gas concentration of high-pressure discharge lamp 10 according to the present embodiment is $9.9\times10^{-7}$ $\mu$mol/mm$^3$. The luminance retention percentage exceeds 80% and 90% while the oxygen partial pressure is in the range from $1\times10^{-2}$ to $5\times10^{-3}$ Pa, and reaches 100% when the oxygen partial pressure is $2\times10^{-3}$ Pa. Therefore, the halogen gas concentration of high-pressure discharge lamp 10 according to the present embodiment is of a value sufficiently small enough not to impair the halogen cycle, but not too small.

The high-pressure discharge lamp according to the above embodiment does not require a large-scale evacuating facility and is of a long service life.

If the halogen gas concentration is high, then the oxygen partial pressure may be considerably high only from the standpoint of preventing the blackening of the lamp tube.

However, excessive oxygen is not preferable as it would oxidize parts of the high-pressure discharge lamp, causing operation failures. For example, if the oxygen partial pressure is 1 Pa ($1.0\times10^{0}$ Pa), then the oxygen would oxidize parts of the high-pressure discharge lamp at the time the high-pressure discharge lamp is manufactured, and the high-pressure discharge lamp would not operate normally immediately after it is manufactured.

Experimental results about the effect that the halogen gas has on gas leakage and lamp bulb rupture will be described below. Mercury was introduced and confined at a rate of 0.20 mg/mm$^3$, an argon gas was introduced and confined at a pressure of 150 kPa, and oxygen had a partial pressure of $5\times10^{-4}$ Pa with various different methylene bromide concentrations, preparing various high-pressure discharge lamps, and after the high-pressure discharge lamps were operated for 2000 hours and 5000 hours, leakage occurrences (gas leakage or lamp bulb rupture) were inspected. The results are shown in Table 1 below. In Table 1, "halogen gas concentrations" refer to methylene bromide concentrations as converted into halogen gas concentrations.

TABLE 1

| Halogen gas concentration ($\mu$mol/mm$^3$) | Leakage occurrences (after 2000 hours of operation) | Leakage occurrences (after 5000 hours of operation) |
|---|---|---|
| $1\times10^{-1}$ | 40 | 70 |
| $2\times10^{-2}$ | 10 | 30 |
| $5\times10^{-4}$ | 0 | 16 |
| $5\times10^{-5}$ | 0 | 7 |
| $9.9\times10^{-7}$ | 0 | 0 |
| $1\times10^{-7}$ | 0 | 0 |
| $1\times10^{-8}$ | 0 | 0 |

In recent years, projection-type liquid crystal display devices are finding applications as projection television sets for use in home theaters, display devices for use in retain stores, etc. These projection-type liquid crystal display devices are energized for a period of time much longer than display devices for use in presentations, and hence need to have a service life of at least 5000 hours.

Table 1 indicates that if the halogen gas concentration is greater than $1\times10^{-6}$ $\mu$mol/mm$^3$, then leakages occur after 5000 hours of operation. In order to make a high-pressure discharge tube operable for 5000 hours, therefore, the halogen gas concentration should be at most $1\times10^{-6}$ $\mu$mol/mm$^3$.

While preferred embodiments of the present invention have been described using specific terms, such description is for illustrative purposes only, and it is to be understood that changes and variations may be made without departing from the spirit or scope of the following claims.

What is claimed is:

1. A high-pressure discharge tube comprising:

a hermetically sealed lamp bulb of quartz glass;

a pair of confronting electrodes inserted in said lamp bulb;

mercury confined in said lamp bulb; and a halogen gas confined in said lamp bulb and having a predetermined concentration;

said lamp bulb containing oxygen at a partial pressure lower than a partial pressure required to maintain, for said predetermined concentration of halogen, a luminance of 80% after 100 hours of operation and equal to or higher than $1.0\times10^{-5}$ Pa.

2. A high-pressure discharge tube according to claim 1, wherein said lamp bulb contains oxygen at a partial pressure lower than a partial pressure which can maintain a luminance of 80% after 100 hours of operation and equal to or higher than 1/10 of a maximum value of a partial pressure which can maintain a luminance of 100% after 100 hours of operation.

3. A high-pressure discharge tube according to claim 1, wherein said lamp bulb contains oxygen at a partial pressure lower than a partial pressure required to maintain a luminance of 80% after 100 hours of operation and equal to or higher than a maximum value of a partial pressure which can maintain a luminance of 100% after 100 hours of operation.

4. A high-pressure discharge tube according to claim 1, wherein said lamp bulb contains oxygen at a partial pressure lower than a partial pressure required to maintain a luminance of 90% after 100 hours of operation and equal to or higher than $1.0\times10^{-5}$ Pa.

5. A high-pressure discharge tube according to claim 1, wherein said lamp bulb contains oxygen at a partial pressure lower than a partial pressure required to maintain a luminance of 90% after 100 hours of operation and equal to or higher than 1/10 of a maximum value of a partial pressure which can maintain a luminance of 100% after 100 hours of operation.

6. A high-pressure discharge tube according to claim 1, wherein said lamp bulb contains oxygen at a partial pressure lower than a partial pressure required to maintain a luminance of 90% after 100 hours of operation and equal to or higher than a maximum value of a partial pressure which can maintain a luminance of 100% after 100 hours of operation.

7. A high-pressure discharge tube according to claim 1, wherein said halogen gas in the lamp bulb has a concentration of at most $9.9\times10^{-7}$ $\mu$mol/mm$^3$.

8. A high-pressure discharge tube according to claim 2, wherein said halogen gas in the lamp bulb has a concentration of at most $9.9\times10^{-7}$ $\mu$mol/mm$^3$.

9. A high-pressure discharge tube according to claim 3, wherein said halogen gas in the lamp bulb has a concentration of at most $9.9\times10^{-7}$ $\mu$mol/mm$^3$.

10. A high-pressure discharge tube according to claim 4, wherein said halogen gas in the lamp bulb has a concentration of at most $9.9\times10^{-7}$ $\mu$mol/mm$^3$.

11. A high-pressure discharge tube according to claim 5, wherein said halogen gas in the lamp bulb has a concentration of at most $9.9\times10^{-7}$ $\mu$mol/mm$^3$.

12. A high-pressure discharge tube according to claim 6, wherein said halogen gas in the lamp bulb has a concentration of at most $9.9\times10^{-7}$ $\mu$mol/mm$^3$.

13. A method of manufacturing a high-pressure discharge tube, comprising the steps of:

hermetically sealing a lamp bulb of quartz glass;

inserting a pair of confronting electrodes in said lamp bulb;

confining mercury in said lamp bulb;

confining a halogen gas in said lamp bulb at a predetermined concentration; and evacuating said lamp bulb so that a partial pressure of oxygen is at a partial pressure lower than a partial pressure required to maintain, for said predetermined concentration of halogen, a luminance of 80 % after 100 hours of operation and equal to or higher than $1.0\times10^{-5}$ Pa.

14. A method of manufacturing a high-pressure discharge tube according to claim 13, wherein said evacuating step produces a partial pressure of oxygen in the lamp bulb lower than a partial pressure required to maintain a luminance of 80 % after 100 hours of operation and equal to or higher than 1/10 of a maximum value of a partial pressure which can maintain a luminance of 100 % after 100 hours of operation.

15. A method of manufacturing a high-pressure discharge tube according to claim 13, wherein said evacuating step produces a partial pressure of oxygen in the lamp bulb lower than a partial pressure required to maintain a luminance of 80 % after 100 hours of operation and equal to or higher than a maximum value of a partial pressure which can maintain a luminance of 100 % after 100 hours of operation.

16. A method of manufacturing a high-pressure discharge tube according to claim 13, wherein said evacuating step produces a partial pressure of oxygen in the lamp bulb lower than a partial pressure required to maintain a luminance of 90 % after 100 hours of operation and equal to or higher than $1.0\times10^{-5}$ Pa.

17. A method of manufacturing a high-pressure discharge tube according to claim 13, wherein said evacuating step produces a partial pressure of oxygen in the lamp bulb lower than a partial pressure required to maintain a luminance of 90 % after 100 hours of operation and equal to or higher than 1/10 of a maximum value of a partial pressure which can maintain a luminance of 100 % after 100 hours of operation.

18. A method of manufacturing a high-pressure discharge tube according to claim 13, wherein said evacuating step produces a partial pressure of oxygen in the lamp bulb lower than a partial pressure required to maintain a luminance of 90 % after 100 hours of operation and equal to or higher than a maximum value of a partial pressure which can maintain a luminance of 100 % after 100 hours of operation.

* * * * *